US011828463B2

(12) United States Patent
Fox et al.

(10) Patent No.: US 11,828,463 B2
(45) Date of Patent: Nov. 28, 2023

(54) FLARE CONTROL USING MULTI-VARIABLE FLARE MONITOR

(71) Applicant: John Zink Company, LLC, Tulsa, OK (US)

(72) Inventors: Scott J. Fox, Pflugerville, TX (US); Ryan D. King, Tulsa, OK (US); Zachary L Kodesh, Tulsa, OK (US)

(73) Assignee: John Zink Company, LLC, Tulsa, OK (US)

( * ) Notice: Subject to any disclaimer, the term of this patent is extended or adjusted under 35 U.S.C. 154(b) by 23 days.

(21) Appl. No.: 17/770,313

(22) PCT Filed: Oct. 13, 2020

(86) PCT No.: PCT/IB2020/059612

§ 371 (c)(1),
(2) Date: Apr. 20, 2022

(87) PCT Pub. No.: WO2021/079228

PCT Pub. Date: Apr. 29, 2021

(65) Prior Publication Data

US 2022/0349580 A1 Nov. 3, 2022

Related U.S. Application Data

(60) Provisional application No. 62/923,914, filed on Oct. 21, 2019.

(51) Int. Cl.
*F23N 5/24* (2006.01)
*F23G 7/08* (2006.01)

(52) U.S. Cl.
CPC ..... *F23N 5/242* (2013.01); *F23G 7/085* (2013.01); *F23N 2223/08* (2020.01)

(58) Field of Classification Search
None
See application file for complete search history.

(56) References Cited

U.S. PATENT DOCUMENTS

2011/0212404 A1* 9/2011 Fan ..... F23N 5/006 431/12
2019/0242575 A1* 8/2019 Fisher ..... F23G 7/085

FOREIGN PATENT DOCUMENTS

EP 2407718 A2 1/2012

OTHER PUBLICATIONS

Yousheng Zeng, 0vercoming Challenges Meeting RSR Flare Monitoring Requirements, Apr. 5, 2018, pp. 1-17, XP055762275, 4C HSE Conference, San Antonio, Texas, USA: URL:https://providencephotonicscom-my.sharepoint.com/personal/whitneytiemann providencephotonics_com/Documents/Past%20Events%2 0Downloads/2018_4C%20Conf_Flare%20RSR/4C2018-Flare%20RSR.pdf.

(Continued)

*Primary Examiner* — Jason Lau

(57) ABSTRACT

Systems and methods for multi-variable flare control include receiving, at a flare controller, a plurality of flare characteristics from a flare monitor. The flare monitor may be an optical flare monitor. The plurality of flare characteristics may include, but are not limited to, Combustion Efficiency (CE), Smoke Index (SI), Flame Stability (FS), Flame Footprint (FF), and Heat Release (HR). The flare controller analyzes a plurality of the flare characteristics and outputs a control signal to control an operating condition of the flare, such as an amount of assist media being fed to the flare. Iterations of the control signal may be bounded by a step value defining a maximum increase or decrease in the control value as compared to the previous control value.

22 Claims, 3 Drawing Sheets

(56) References Cited

OTHER PUBLICATIONS

International Search Report and Written Opinion of the International Searching Authority that issued in international patent application No. PCT/IB2020/059612 dated Jan. 28, 2021.

* cited by examiner

FLARE CONTROL USING MULTI-VARIABLE FLARE MONITOR

RELATED APPLICATIONS

This application is a filing under 35 U.S.C. 371 as the National Phase of International Patent Application No. PCT/IB2020/059612, filed on Oct. 13, 2020, which claims the benefit of and priority from U.S. Provisional Patent Application Ser. No. 62/923,914, filed on Oct. 21, 2019 The entire contents of each of the aforementioned applications are incorporated herein as if fully set forth.

BACKGROUND

Process plants use flaring systems to burn excess gas within the system. Flares receive gas from a header system and ignite the received gas to combust the gas composition. FIG. 1 depicts a process system 100 including a process plant 102 (e.g., a process heater) that pushes excess gas into a header 104 that is received by a flare 106 which combusts the excess gas. Combustion control of the excess gas being burned is important to reduce emissions levels, particularly as increased regulation is enacted.

BRIEF DESCRIPTION OF THE FIGURES

The foregoing and other features and advantages of the disclosure will be apparent from the more particular description of the embodiments, as illustrated in the accompanying drawings, in which like reference characters refer to the same parts throughout the different figures. The drawings are not necessarily to scale, emphasis instead being placed upon illustrating the principles of the disclosure.

DETAILED DESCRIPTION OF THE EMBODIMENTS

As combustion system technology has developed, sensor-based monitor technology has also developed. For example, a variety of sensors have been developed to monitor the components of the combustion system 100. One such example, is the Mantis Flare Monitor by Providence Photonics. The present embodiments acknowledge that human-based, or even machine-assisted, flare control can be improved by utilizing developing sensor technologies. The present embodiments resolve this problem by developing a logic and control system that utilizes multiple variables of the flare to automatically control the flare and achieve a more efficient and clean burn.

Figure 1:
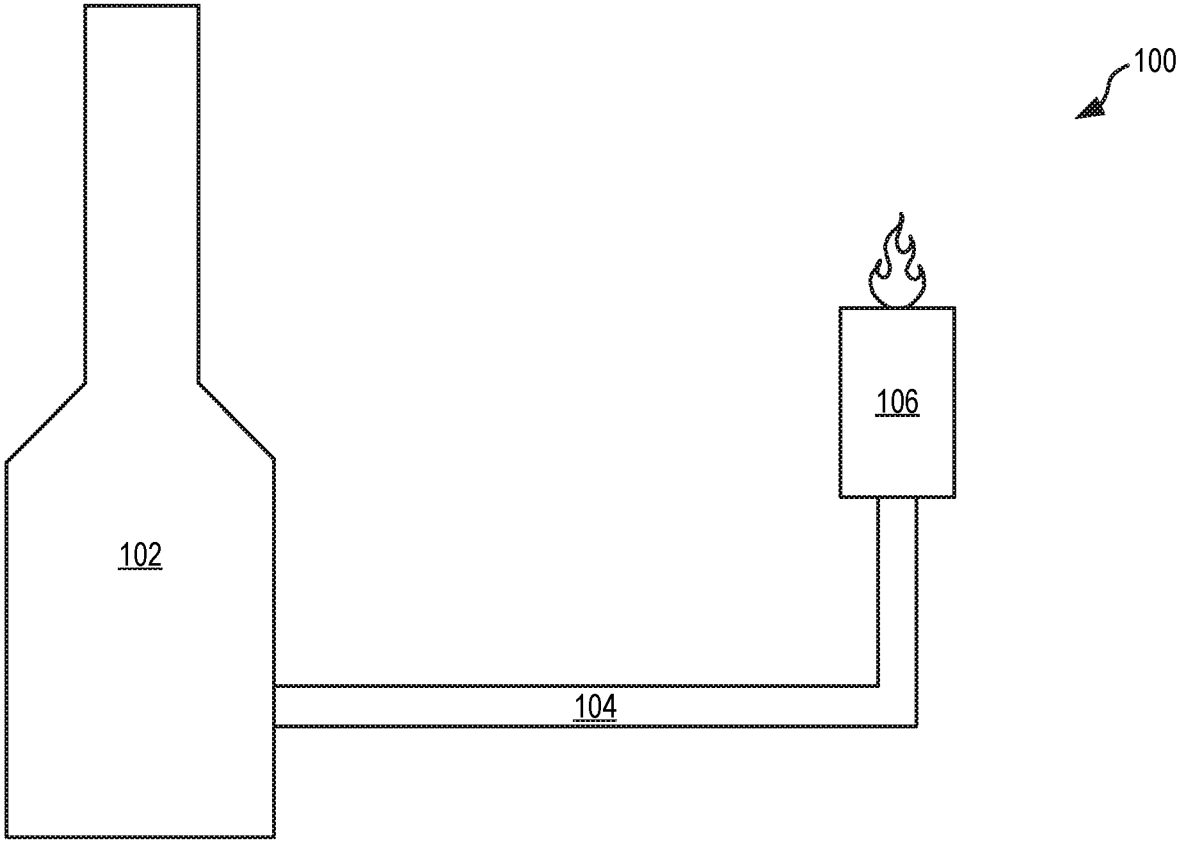
FIG. 1 depicts a process system including a process plant (e.g., a process heater) that pushes excess gas into a header that is received by a flare which combusts the excess gas.
Figure 2:
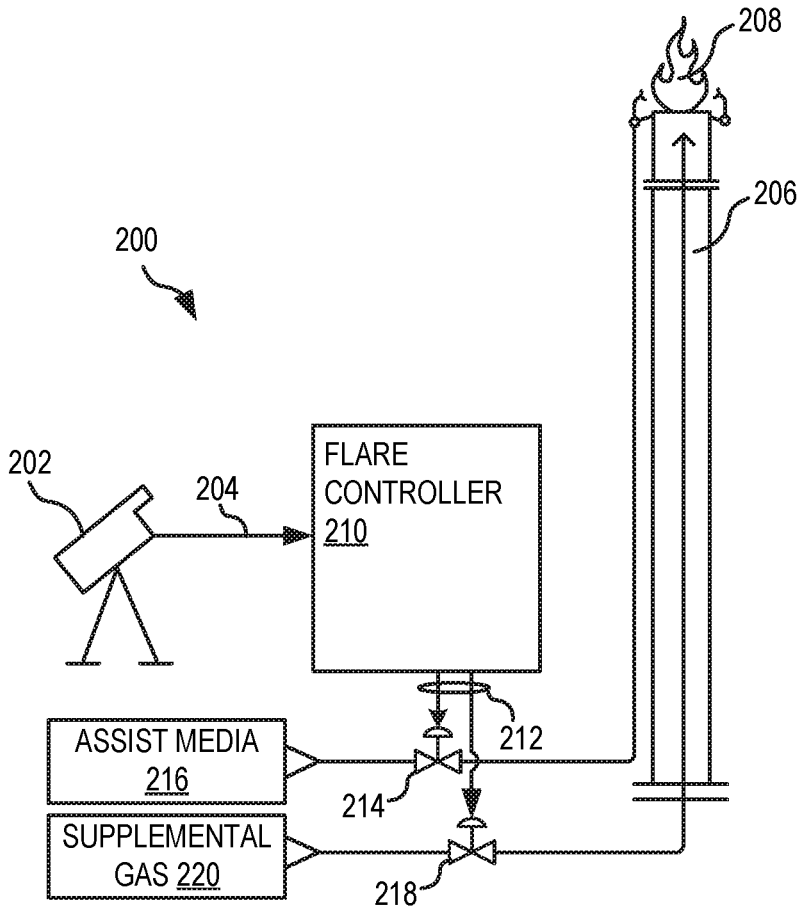
FIG. 2 depicts an example system for flare control using a multi-variable flare monitor, in an embodiment.

FIG. 2 depicts an example system 200 for flare control using a multi-variable flare monitor 202, in an embodiment. System 200 includes the multi-variable flare monitor 202. An example of the multi-variable flare monitor 202 is an optical flare monitor, such as the Mantis Flare Monitor by Providence Photonics. The multi-characteristic optical monitor 202 is capable of producing an output 204 simultaneously indicating a plurality of flame characteristics of a flame 208 produced by flare 206. Flare 206 is an example of flare 106. The output 204 includes a plurality of characteristics, for example performance metrics including Combustion Efficiency (CE), Smoke Index (SI), Flame Stability (FS), Flame Footprint (FF), and Heat Release (HR). Sensors other than the Mantis, and other characteristics may be monitored without departing from the scope hereof.

The output 204 of the multi-variable flare monitor 202 is fed into a flare controller 210. The flare controller 210 may be a component of the distributed control system (DSC) that controls the operation of the combustion system (e.g., combustion system 100), or it may be a control system dedicated to control of the flare 206. Furthermore, the flare controller 210 may be a digital-based controller, a discrete logic-based controller, or a combination thereof. A digital-based controller as used herein comprises computer readable instructions that when executed by a processor cause the controller 210 to implement the functionality discussed below. A discrete logic-based controller as used herein includes individual electronics components, including PID controllers, that are coupled in series or parallel to analyze given inputs and produce associated outputs according to the functionality discussed below. The discrete-logic based controllers may implement Boolean logic, non-Boolean logic, or combinations thereof. It should be appreciated that, unless specified herein otherwise, discrete-logic based control functionality may be implemented in digital-based controller, and vice versa.

The flare controller 210 processes the outputs 204 of the multi-variable flare monitor 202 to generate one or more control signals 212 that control operation of the flare 206. In at least some embodiments, a first of said one or more control signals 212 may operate a control valve 214 that increases or decreases an amount of assist media 216 provided to the flare 206. The assist media may be any type of assist media known in the art, and may be based on the type of flare, such as steam, air, gas, etc. For example, where flare 206 is a steam-assisted flare, the assist media 216 may be steam and operate to use high pressure steam to entrain surrounding air and inject it into the core of the flare gas stream. The rapid mixing of steam and air with the flare gas helps reduce soot formation which tends to lower the smoke index and lower the flame radiant fraction. Furthermore, a second of said one or more control signals 212 may operate a control valve 218 that increases or decreases an amount of supplemental gas 220 provided to the flare 206. The supplemental gas 220, for example, may be a hydrocarbon used to enrich a vent gas stream. It should be appreciated that, although the control signals 212 are shown controlling valves (e.g., control valves 214, 218), the control signals 212 may control other devices. For example, if the assist media is air-based, the associated control signal may control a blower or other device that impacts the amount of air being fed to the flare 206.

Figure 3:
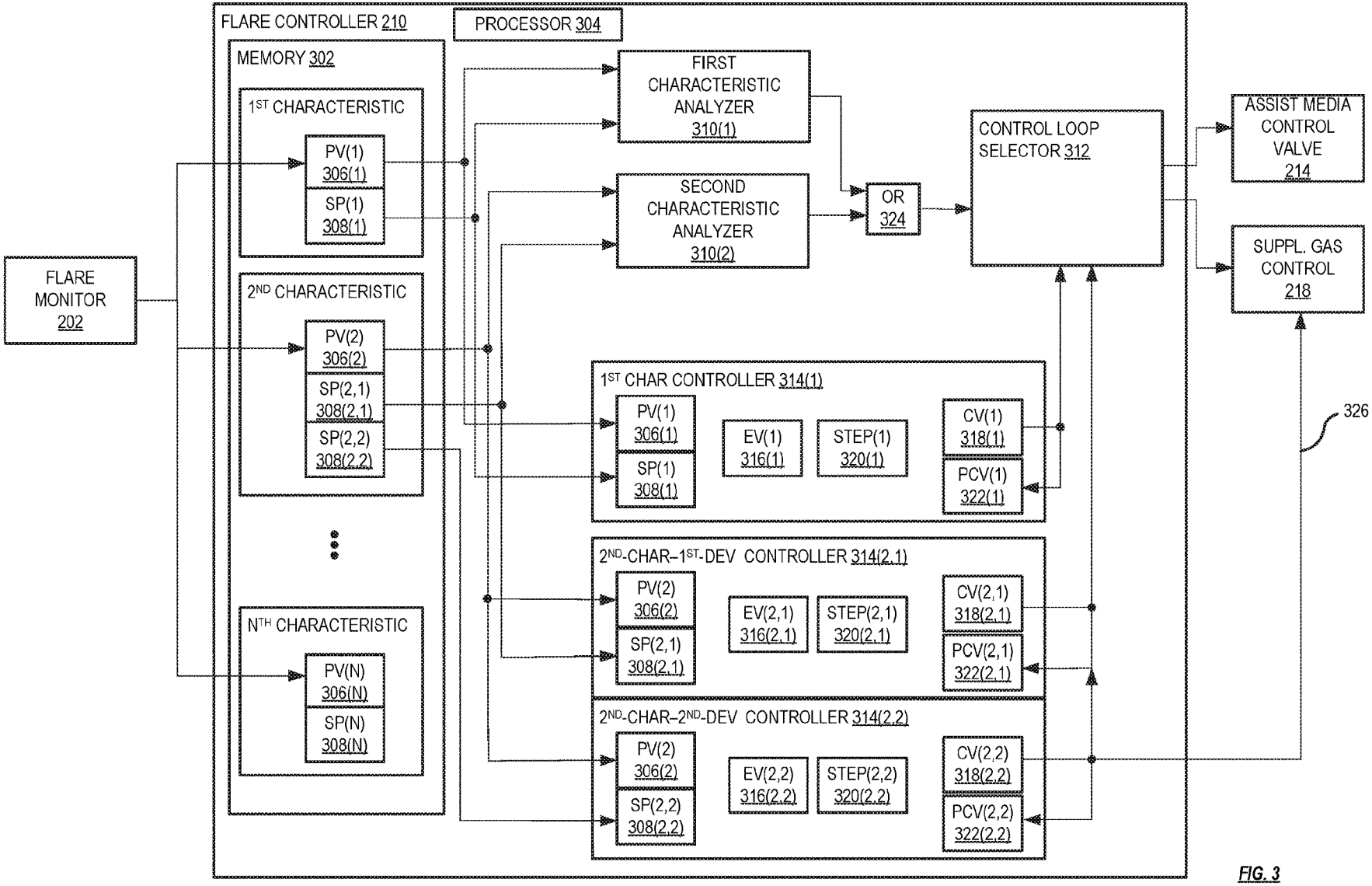
FIG. 3 depicts the control logic implemented by flare controller in further detail, in an embodiment.

FIG. 3 depicts the control logic implemented by flare controller 210 in further detail, in an embodiment. The flare controller 210 may include a memory 302 and processor 304. The flare monitor 202 transmits outputs 204 to the flare controller 210, which are then stored in memory of the flare controller 210 (or fed directly to discrete-logic circuitry). The outputs 204 may include any number N of characteristics (e.g., as discussed above the Mantis Optical monitor includes at least five outputs). The process value 306 of each characteristic is shown in FIG. 3 as PV(1), PV(2), . . . PV(N). The process value 306 may be a direct reading that indicates a value of the associated characteristic. For example, if characteristic PV(1) 306(1) is the process value of the Smoke Index, then the reading may be a reading between 0-10 as output by the flame monitor 202. The PV 306 stored within the memory 302 may be conditioned (either by the flare monitor 202, or by the flare controller 210) prior to storage therein, particularly where raw data from the flare monitor 202 must be translated into a representative value of the associated characteristic.

Also stored in memory are a respective set-point 308 for each characteristic. The set-points 308 indicate a value, either received by the flare controller 210 as input from a system operator, input into the flare controller 210 that corresponds to acceptable (and/or desired) values read by the flare monitor 202. The set-point 308 may be a single value, or may be a range of values depending on the given characteristic.

The flare controller 210 further includes a plurality of characteristic analyzers 310. In at least some embodiments, each character analyzer 310 may be in the form of computer readable instructions stored in the memory 302 that when executed by the processor 304 cause the processor to implement the functionality of the character analyzer 310 described herein. In at least some embodiments, each character analyzer 310 is implemented by Boolean and/or non-Boolean logic circuitry.

A first characteristic analyzer 310(1) and a second analyzer 310(2) are shown, but it should be appreciated that there may be any number of characteristic analyzers 310 without departing from the scope hereof. In at least some embodiments, there are fewer characteristic analyzers 310 than number of characteristics output from the flare monitor 202. In at least some embodiments, there are the same number of characteristic analyzers 310 as number of characteristics output from the flare monitor 202. Each characteristic analyzer 310 compares the process value 306 to the set-point 308 for a given characteristic. Each characteristic analyzer 310 may operate in series, or in parallel, or both, with other(s) of the characteristic analyzers 310.

Each characteristic analyzer 310 outputs a true or false indication as to whether the given process value 306 is acceptable when compared to the set-point 308. The outputs from each characteristic analyzer 310 are input into a control loop selector 312 that determines one of a plurality of characteristic controllers 314. The control loop selector 312 prioritizes which of the characteristics analyzed by the characteristic analyzers 310 is most important to use to control the flare 206.

The characteristic controllers 314 determine an error value 316 that represents the difference between the process value 306 and the set-point 308. In at least some embodiments, each characteristic controller 314 may be in the form of computer readable instructions stored in the memory 302 that when executed by the processor 304 cause the processor to implement the functionality of the characteristic controller 314 described herein. In at least some embodiments, each characteristic controller 314 is implemented by Boolean and/or non-Boolean logic circuitry. In at least some embodiments, characteristic controller 314 is a PID controller. Each characteristic controller 314, when selected by the control loop selector 312, then outputs a control value 318 that is relayed to the device (e.g., the assist media control valve 214, and/or the supplemental gas control valve 218).

In at least some embodiments, a characteristic controller 314 for a given characteristic may be configured to control a plurality of devices. For example, the second characteristic controller 314(2) in FIG. 3 is shown having a primary device controller 314(2,1) that controls for example the assist media control valve 214, and a secondary device controller 314(2,2) that controls for example the supplementary gas control valve 218. Similarly, multiple set-points 308 may be defined for a given characteristic. For example, a primary controller set-point 308(2,1) is set for use by the first characteristic primary controller 314(2,1), and a secondary controller set-point 308(2,2) is set for use by the first characteristic secondary controller 314(2,2). Thus, two components of the flare 206 and associated inputs may be controlled based on a single characteristic output by the flare monitor 202. It should be appreciated that although the primary and secondary characteristic controllers are shows as part of the same characteristic controller 314(2), it should be appreciated that any characteristic controller could be implemented independently, even if not initiated by the control loop selector 312.

In at least some embodiments, the control value 318 is based on a step-value 320. The step-value 320 defines a maximum change that the control value 318 an effect to the controlled device. Thus, as the flare controller 210 iterates control, the flare 206 is incrementally controlled to avoid drastic spikes in control of the flare 206.

In at least some embodiments, the control value 318 is based on a previous control value 322. The previous control value 322 is a feedback loop that causes the flare controller 210 to use the last actual control output to the controlled device the next control value determination. This functionality prevents a drastic control value change in a when one characteristic controller 314 takes over from another.

Example: Smoke Index and Combustion Efficiency Control

The following description establishes a working example for control of a flare based on a Smoke Index and a Combustion Efficiency characteristic output by, for example, the Mantis Optical Flare Monitor. The following description is for example, and is not intended to limit the overall scope of the present disclosure.

The flare monitor 202 may output a process value 306(1) for the Smoke Index between 0 to 10 to the tenth decimal. The set-point 308(1) for the smoke index may be set between 0-1.5, for example at 0.9. The flare monitor 202 may output a process value 306(2) for the combustion efficiency between 60 to 100 percent. A first set-point 310(2,1) for the combustion efficiency may be set between 96-100 percent, such as 99. A second set-point 310(2,2) for the combustion efficiency may be set lower (or, in some embodiments, the same as; or, in some embodiments, higher than) than the first set-point 310(2,1) such as 96.5.

The first characteristic analyzer 310(1) compares the smoke index process value 306(1) to the smoke index set-point 308(1). If the smoke index process value 306(1) is greater than the smoke index set-point 308(1), then the first characteristic analyzer 310(1) may output a value of true (indicating that control of the assist media device should occur according to smoke index efficiency analysis).

The second characteristic analyzer 310(2) compares the combustion efficiency process value 306(2) to the combustion efficiency set-point 308(2,1). If the combustion efficiency process value 306(2) is greater than (or, in some embodiments, greater than or equal to) the combustion efficiency set-point 308(2,1), then the second characteristic analyzer 310(1) may output a value of true (indicating that control of the assist media device should occur according to smoke index analysist).

The second characteristic analyzer 310(2) compares the combustion efficiency process value 306(2) to the combustion efficiency set-point 308(2,1). If the combustion efficiency process value 306(2) is less than (or, in some embodiments, less than or equal to) the combustion efficiency set-point 308(2,1), then the second characteristic analyzer 310(1) may output a value of false (indicating that control of the assist media device should occur according to combustion efficiency analysis, unless the smoke index is above the set-point.

In FIG. 3, the outputs of the first and second characteristic analyzer 310 are shown as inputs into an OR function 324, such that the input to the control loop selector 312 is true if either (1) the smoke index process value 306(1) is greater than the smoke index set-point 308(1), or (2) the combustion efficiency process value 306(2) is greater than (or, in some embodiments, greater than or equal to) the combustion efficiency set-point 308(2,1).

The control loop selector 312 is configured, if the input from the OR function (or a corresponding digital analyses indicates) indicates true, to initiate the first characteristic controller 314 (1), which controls the assist media control valve 214 based on the smoke index process value 306(1). If the input of the OR function (or a corresponding digital analyses indicates), the control loop selector 312 is configured to initiate the second characteristic controller 314 (2) which controls the assist media control valve 214 (and optionally the supplemental gas valve 218) based on the combustion efficiency process value 306(2).

The first characteristic controller 314(1) determines the smoke index error value 316(1) based on the difference between the smoke index process value 306(1). The first characteristic controller 314 (1) outputs a control value 318(1) that is transmitted to and controls the assist media control valve 214. The first characteristic controller 314(1) may calculate the output control value 318(1) using a previous control value 322(1). Furthermore, the first characteristic controller 314(1) may calculate the output control value 318(1) based on the step value 320(1).

The second-characteristic-first-device controller 314(2,1) determines the combustion efficiency error value 316(2,1) based on the difference between the combustion efficiency process value 306(1) and the combustion efficiency set-point 308(2,1). The second-characteristic-first-device controller 314(2,1) outputs a control value 318(2,1) that is transmitted to and controls the assist media control valve 214. The second-characteristic-first-device controller 314(2,1) may calculate the output control value 318(2,1) using a previous control value 322(2,1). Furthermore, the second-characteristic-first-device controller 314(2,1) may calculate the output control value 318(2,1) based on the step value 320(2,1).

The second-characteristic-second-device controller 314 (2,2) determines the combustion efficiency error value 316 (2,2) based on the difference between the combustion efficiency process value 306(1) and the combustion efficiency set-point 308(2,2). The second-characteristic-second-device 314(2,2) outputs a control value 318(2,2) that is transmitted to and controls the supplemental gas control valve 218. The second-characteristic-second-device 314(2,2) may calculate the output control value 318(2,2) using a previous control value 322(2,2). Furthermore, the second-characteristic-second-device 314(2,2) may calculate the output control value 318(2,2) based on the step value 320(2,2). It should be appreciated that the second-characteristic-second-device controller 314(2,2) may be implemented in parallel, in series to, or entirely independent from (as indicated by arrow 326) the second-characteristic-first-device controller 314(2,1).

The above described systems, and methods implemented thereby, achieve smokeless combustion with minimum assist media flow rate and can control supplemental fuel gas to maintain a high combustion efficiency when the vent gas is lean has value to our clients. The above described systems, and methods implemented thereby, use two or more signals from a flare monitor (e.g., an optical based flare monitor), analyzes those signals using control logic, and the outputs signals to automatically control assist-media and/or supplemental gas used by the flare. The embodiments described herein control the flare to maintain a high combustion efficiency while at the same time preventing smoke. The embodiments described herein optimize the assist media flow rate to a minimum required for smokeless operation. The embodiments described herein automatically adjust for varying wind conditions, varying vent gas flow rate, and varying vent gas composition. The embodiments described herein eliminate operator intervention for flare control adjustments.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween. Without limiting the forgoing, certain embodiments of the invention are illustrated by a system for multi-variable flare control, comprising a flare controller that:

- receives a plurality of flare characteristics from a flare monitor,
- compares a first process value for a first of the plurality of flare characteristics against a first set-point value for the first of the plurality of flare characteristics,
- compares a second process value for a second of the plurality of flare characteristics against a second set-point value for the second of the plurality of flare characteristics,
- when the first process value has an unacceptable first relationship to the first set-point, regardless of a second relationship of the second process value to the second set-point, output a first control signal to an assist media control, the first control signal being based on a first error value of the first process value;
- when the second process value has an unacceptable second relationship to the second set-point, and the first relationship is acceptable, output a second control signal based on a second error value of the second process value; and,
- when both the second relationship and the first relationship are acceptable, output the first control signal. The system can further comprise the flare monitor, which can be an optical flare monitor capable of simultaneously generating a plurality of characteristics of a flare.

The flare controller can be configured to generate a third control signal based on another error rate of the second process value. The another error rate can be the difference between another set point of the second characteristic and the second process value. Additionally, in the above embodiments, the first error rate can be the difference between the first set point and the first process value, and/or the second error rate can be the difference between the second set point and the second process value. Further, a control value of the first control signal can be based on a previous control value of the last control signal sent to the assist media control and/or the control value of the first control signal can be based on a step value defining a maximum increase or decrease in the control value as compared to the previous control value.

What is claimed is:

1. A system for multi-variable flare control, comprising:
an optical flare monitor capable of simultaneously generating a plurality of characteristics of a flare; and
a flare controller that:
receives a plurality of flare characteristics from the optical flare monitor,
compares a first process value for a first of the plurality of flare characteristics against a first set-point value for the first of the plurality of flare characteristics,
compares a second process value for a second of the plurality of flare characteristics against a second set-point value for the second of the plurality of flare characteristics,
when the first process value has an unacceptable first relationship to the first set-point, regardless of a second relationship of the second process value to the second set-point, output a first control signal to an assist media control such that control of an assist media is in accordance with the first control signal, wherein the first control signal is based on a first error value of the first process value;
when the second process value has an unacceptable second relationship to the second set-point, and the first relationship is acceptable, output a second control signal to the assist media control such that control of the assist media is in accordance with the second control signal, wherein the second control signal is based on a second error value of the second process value; and,
when both the second relationship and the first relationship are acceptable, output the first control signal to the assist media control such that control of the assist media is in accordance with the first control signal.

2. The system of claim 1, wherein the flare controller is further configured to generate a third control signal based on another error rate of the second process value.

3. The system of claim 2, wherein the another error rate is the difference between another set point of the second characteristic and the second process value.

4. The system of claim 1, wherein the first error value is the difference between the first set point and the first process value.

5. The system of claim 1, wherein the second error value is the difference between the second set point and the second process value.

6. The system of claim 1, wherein a control value of the first control signal is further based on a previous control value of the last control signal send to the assist media control.

7. The system of claim 6, wherein the control value of the first control signal is further based on a step value defining a maximum increase or decrease in the control value as compared to the previous control value.

8. A system for multi-variable flare control, comprising:
an optical flare monitor capable of simultaneously generating a plurality of characteristics of a flare; and
a flare controller that:
receives a plurality of flare characteristics from the flare monitor,
compares a first process value for a first of the plurality of flare characteristics against a first set-point value for the first of the plurality of flare characteristics,
compares a second process value for a second of the plurality of flare characteristics against a second set-point value for the second of the plurality of flare characteristics,
when the first process value has an unacceptable first relationship to the first set-point, regardless of a second relationship of the second process value to the second set-point, output a first control signal to an assist media control, wherein the first control signal is based on a first error value of the first process value;
when the second process value has an unacceptable second relationship to the second set-point, and the first relationship is acceptable, output a second control signal based on a second error value of the second process value; and,
when both the second relationship and the first relationship are acceptable, output the first control signal.

9. The system of claim 8, wherein the flare controller is further configured to generate a third control signal based on another error rate of the second process value.

10. The system of claim 9, wherein the another error rate is the difference between another set point of the second characteristic and the second process value.

11. The system of claim 9, wherein the first error value is the difference between the first set point and the first process value.

12. The system of claim 9, wherein the second error value is the difference between the second set point and the second process value.

13. The system of claim 9, wherein a control value of the first control signal is further based on a previous control value of the last control signal sent to the assist media control.

14. The system of claim 13, wherein the control value of the first control signal is further based on a step value defining a maximum increase or decrease in the control value as compared to the previous control value.

15. A system for multi-variable flare control, comprising:
a flare controller that:
receives a plurality of flare characteristics from a flare monitor,
compares a first process value for a first of the plurality of flare characteristics against a first set-point value for the first of the plurality of flare characteristics,
compares a second process value for a second of the plurality of flare characteristics against a second set-point value for the second of the plurality of flare characteristics,
when the first process value has an unacceptable first relationship to the first set-point, regardless of a second relationship of the second process value to the second set-point, output a first control signal to an assist media control, the first control signal is based on a first error value of the first process value, and wherein a control value of the first control signal is further based on a previous control value of the last control signal sent to the assist media control;
when the second process value has an unacceptable second relationship to the second set-point, and the first relationship is acceptable, output a second control signal based on a second error value of the second process value; and,
when both the second relationship and the first relationship are acceptable, output the first control signal.

16. The system of claim 15, further comprising the flare monitor.

17. The system of claim 16, wherein the flare monitor is an optical flare monitor capable of simultaneously generating a plurality of characteristics of a flare.

18. The system of claim 17, wherein the flare controller is further configured to generate a third control signal based on another error rate of the second process value.

19. The system of claim 18, wherein the another error rate is the difference between another set point of the second characteristic and the second process value.

20. The system of claim 19, wherein the first error value is the difference between the first set point and the first process value.

21. The system of claim 20, wherein the second error value is the difference between the second set point and the second process value.

22. The system of claim 20, wherein the control value of the first control signal is further based on a step value defining a maximum increase or decrease in the control value as compared to the previous control value.

* * * * *